US006203717B1

(12) United States Patent
Munoz et al.

(10) Patent No.: US 6,203,717 B1
(45) Date of Patent: Mar. 20, 2001

(54) STABLE MAGNETORHEOLOGICAL FLUIDS

(75) Inventors: Beth C. Munoz, Pasadena, CA (US); Gary W. Adams, Holly Springs, NC (US); Van Trang Ngo; John R. Kitchin, both of Raleigh, NC (US)

(73) Assignee: Lord Corporation, Cary, NC (US)

( * ) Notice: Subject to any disclaimer, the term of this patent is extended or adjusted under 35 U.S.C. 154(b) by 0 days.

(21) Appl. No.: 09/340,248

(22) Filed: Jul. 1, 1999

(51) Int. Cl.[7] ..... H01B 1/44

(52) U.S. Cl. ..... 252/62.52; 282/62.51 R; 282/62.55

(58) Field of Search ..... 252/62.52, 62.51 R, 252/62.516, 62.55, 62.56

(56) References Cited

U.S. PATENT DOCUMENTS

| | | | |
|---|---|---|---|
| Re. 32,573 | 1/1988 | Furumura et al. | 252/62.52 |
| 2,575,360 | 11/1951 | Rabinow | 252/62.52 |
| 2,661,825 | 12/1953 | Winslow | 192/21.5 |
| 2,886,151 | 5/1959 | Winslow | 252/62.52 |
| 5,277,281 | 1/1994 | Carlson et al. | 188/267 |
| 5,353,839 | 10/1994 | Kordonsky et al. | 137/806 |
| 5,390,121 | 2/1995 | Wolfe | 364/424.05 |
| 5,446,076 | 8/1995 | Sommese et al. | 523/200 |
| 5,487,840 | 1/1996 | Yabe et al. | 252/62.51 R |
| 5,547,049 * | 8/1996 | Weiss et al. | 188/267 |
| 5,578,238 * | 11/1996 | Weiss et al. | 252/62.52 |
| 5,599,474 * | 2/1997 | Weiss et al. | 252/62.52 |
| 5,645,752 | 7/1997 | Weiss et al. | 232/62.54 |
| 5,667,715 | 9/1997 | Foister | 252/62.52 |
| 5,670,077 | 9/1997 | Carlson et al. | 252/62.52 |
| 5,816,587 | 10/1998 | Stewart et al. | 280/5.516 |

FOREIGN PATENT DOCUMENTS

WO 98/29521 7/1998 (WO) .

OTHER PUBLICATIONS

"Bentone, Baragel, Nykon Rheological Additives—Organoclay Gellants for the Lubrication Industry" Rheox, Inc. no date.

RHEOX Inc, Bentone Baragel Nykon Rheological Additives.*

* cited by examiner

*Primary Examiner*—C. Melissa Koslow
(74) *Attorney, Agent, or Firm*—Wayne W. Rupert

(57) ABSTRACT

Magnetorheological fluid compositions that include a carrier fluid, magnetic-responsive particles and an organoclay. These fluids exhibit superior soft sedimentation.

9 Claims, No Drawings

STABLE MAGNETORHEOLOGICAL FLUIDS

FIELD OF THE INVENTION

The present invention is directed to fluid materials that exhibit substantial increases in flow resistance when exposed to magnetic fields.

BACKGROUND OF THE INVENTION

Magnetorheological fluids are fluid compositions that undergo a change in apparent viscosity in the presence of a magnetic field. The fluids typically include ferromagnetic or paramagnetic particles dispersed in a carrier fluid. The particles become polarized in the presence of an applied magnetic field, and become organized into chains of particles within the fluid. The particle chains increase the apparent viscosity (flow resistance) of the fluid. The particles return to an unorganized state when the magnetic field is removed, which lowers the viscosity of the fluid.

Magnetorheological fluids have been proposed for controlling damping in various devices, such as dampers, shock absorbers, and elastomeric mounts. They have also been proposed for use in controlling pressure and/or torque in brakes, clutches, and valves. Magnetorheological fluids are considered superior to electrorheological fluids in many applications because they exhibit higher yield strengths and can create greater damping forces.

Magnetorheological fluids are distinguishable from colloidal magnetic fluids or ferrofluids. In colloidal magnetic fluids, the particle size is generally between 5 and 10 nanometers, whereas the particle size in magnetorheological fluids is typically greater than 0.1 micrometers, usually greater than 1.0 micrometers. Colloidal magnetic fluids tend not to develop particle structuring in the presence of a magnetic field, but rather, the fluid tends to flow toward the applied field.

Some of the first magnetorheological fluids, described, for example, in U.S. Pat. Nos. 2,575,360, 2,661,825, and 2,886,151, included reduced iron oxide powders and low viscosity oils. These mixtures tend to settle as a function of time, with the settling rate generally increasing as the temperature increases. One of the reasons why the particles tend to settle is the large difference in density between the oils (about 0.7–0.95 g/cm$^3$) and the metal particles (about 7.86 g/cm$^3$ for iron particles). The settling interferes with the magnetorheological activity of the material due to non-uniform particle distribution. Often, it requires a relatively high shear force to re-suspend the particles.

Various surfactants and suspension agents have been added to the fluids to keep the particles suspended in the carrier. Conventional surfactants include metallic soap-type surfactants such as lithium stearate and aluminum distearate. These surfactants typically include a small amount of water, which can limit the useful temperature range of the materials.

In addition to particle settling, another limitation of the fluids is that the particles tend to cause wear when they are in moving contact with the surfaces of various parts. It would be advantageous to have magnetorheological fluids that do not cause significant wear when they are in moving contact with surfaces of various parts. It would also be advantageous to have magnetorheological fluids that are capable of being re-dispersed with small shear forces after the magnetic-responsive particles settle out. The present invention provides such fluids.

SUMMARY OF THE INVENTION

Magnetorheological fluid compositions, devices including the compositions, and methods of preparation and use thereof are disclosed. The compositions include a carrier fluid, magnetic-responsive particles, and a hydrophobic organoclay. The fluids typically develop structure when exposed to a magnetic field in as little as a few milliseconds. The fluids can be used in devices such as clutches, brakes, exercise equipment, composite structures and structural elements, dampers, shock absorbers haptic devices, electric switches, prosthetic devices, including rapidly setting casts, and elastomeric mounts.

The hydrophobic organoclay is present as an anti-settling agent, which provides for a soft sediment once the magnetic particles settle out. The soft sediment provides for ease of re-dispersion. The hydrophobic organoclay is also substantially thermally, mechanically and chemically stable and typically has a hardness less than that of conventionally used anti-settling agents such as silica or silicon dioxide. In addition, it has been unexpectedly found that hydrophilic clays do not provide the soft sedimentation exhibited by the hydrophobic organoclays. The fluids of the invention typically shear thin at shear rates less than 100/sec$^{-1}$, and typically recover their structure after shear thinning in less than five minutes.

DETAILED DESCRIPTION OF THE INVENTION

The compositions form a thixotropic network that is effective at minimizing particle settling and also in lowering the shear forces required to re-suspend the particles once they settle. The compositions described herein have a relatively low viscosity, do not settle hard, and can be easier to re-disperse than conventional magnetorheological fluids, including those which contain conventional anti-settling agents such as silicon dioxide or silica.

Thixotropic networks are suspensions of colloidal or magnetically active particles that, at low shear rates, form a loose network or structure (for example, clusters or flocculates). The three dimensional structure supports the particles, thus minimizing particle settling. When a shear force is applied to the material, the structure is disrupted or dispersed. The structure reforms when the shear force is removed.

The compositions typically have at least ten percent less sediment hardness than comparative fluids that include silica rather than the hydrophobic organoclay, where the test involves repeated heating and cooling cycles over a two week period. The compositions also typically cause at least ten percent less device wear than comparative fluids that include silica rather than the hydrophobic organoclay.

I. Magnetorheological Fluid Composition

A. Magnetic-Responsive Particles

Any solid that is known to exhibit magnetorheological activity can be used, specifically including paramagnetic, superparamagnetic and ferromagnetic elements and compounds. Examples of suitable magnetizable particles include iron, iron alloys (such as those including aluminum, silicon, cobalt, nickel, vanadium, molybdenum, chromium, tungsten, manganese and/or copper), iron oxides (including $Fe_2O_3$ and $Fe_3O_4$), iron nitride, iron carbide, carbonyl iron, nickel, cobalt, chromium dioxide, stainless steel and silicon steel. Examples of suitable particles include straight iron powders, reduced iron powders, iron oxide powder/straight iron powder mixtures and iron oxide powder/reduced iron powder mixtures. A preferred magnetic-responsive particulate is carbonyl iron, preferably, reduced carbonyl iron.

The particle size should be selected so that it exhibits multi-domain characteristics when subjected to a magnetic field. Average particle diameter sizes for the magnetic-responsive particles are generally between 0.1 and 1000 $\mu$m, preferably between about 0.1 and 500 $\mu$m, and more preferably between about 1.0 and 10 $\mu$m, and are preferably present in an amount between about 5 and 50 percent by volume of the total composition.

B. Carrier fluids

The carrier fluids can be any organic fluid, preferably a non-polar organic fluid, including those previously used by those of skill in the art for preparing magnetorheological fluids as described, for example. The carrier fluid forms the continuous phase of the magnetorheological fluid. Examples of suitable fluids include silicone oils, mineral oils, paraffin oils, silicone copolymers, white oils, hydraulic oils, transformer oils, halogenated organic liquids (such as chlorinated hydrocarbons, halogenated paraffins, perfluorinated polyethers and fluorinated hydrocarbons) diesters, polyoxyalkylenes, fluorinated silicones, cyanoalkyl siloxanes, glycols, and synthetic hydrocarbon oils (including both unsaturated and saturated). A mixture of these fluids may be used as the carrier component of the magnetorheological fluid. The preferred carrier fluid is non-volatile, non-polar and does not include any significant amount of water. Preferred carrier fluids are synthetic hydrocarbon oils, particularly those oils derived from high molecular weight alpha olefins of from 8 to 20 carbon atoms by acid catalyzed dimerization and by oligomerization using trialuminum alkyls as catalysts. Poly-$\alpha$-olefin is a particularly preferred carrier fluid.

The viscosity of the carrier component is preferably between 1 to 100,000 centipoise at room temperature, more preferably, between 1 and 10,000 centipoise, and, most preferably, between 1 and 1,000 centipoise.

C. Organoclays

Hydrophobic organoclays are used in the fluid compositions described herein as anti-settling agents, thickening agents and rheology modifiers. They increase the viscosity and yield stress of the magnetorheological fluid compositions described herein. The organoclays are typically present in concentrations of between about 0.1 to 6.5, preferably 3 to 6, weight percent, based on the weight of the total composition.

The hydrophobic organoclay provides for a soft sediment once the magnetic-responsive particles settle out. The soft sediment provides for ease of re-dispersion. Suitable clays are thermally, mechanically and chemically stable and have a hardness less than that of conventionally used anti-settling agents such as silica or silicon dioxide. Compositions of the invention described herein preferably shear thin at shear rates less than 100/sec, and recover their structure after shear thinning in less than five minutes.

The organoclays suitable for use in the magnetorheological fluid compositions described herein are typically derived from bentonites. Bentonite clays tend to be thixotropic and shear thinning, i.e., they form networks which are easily destroyed by the application of shear, and which reform when the shear is removed. As used herein, "derived" means that a bentonite clay material is treated with an organic material to produce the organoclay. Bentontie, smectite and montmorillonite are sometimes used interchangeably. However, as used herein, "bentonite" denotes a class of clays that include smectite clays, montmorillonite clays and hectorite clays. Montmorillonite clay typically constitutes a large portion of bentonite clays. Montmorillonite clay is an aluminum silicate. Hectorite clay is a magnesium silicate.

The clays are modified with an organic material to replace the inorganic surface cations with organic surface cations via conventional methods (typically a cation exchange reaction). Examples of suitable organic modifiers include amines, carboxylates, phosphonium or sulfonium salts, or benzyl or other organic groups. The amines can be, for example, quaternary or aromatic amines.

It is believed that organoclays orient themselves in an organic solution via a similar mechanism as that involved with clays in aqueous solutions. However, there are fundamental differences between the two. For example, oils cannot solvate charges as well as aqueous solutions. The gelling properties of organoclays depend largely on the affinity of the organic moiety for the base oil. Other important properties are the degree of dispersion and the particle/particle interactions. The degree of dispersion is controlled by the intensity and duration of shear forces, and sometimes by the use of a polar activator. The particle/particle interactions are largely controlled by the organic moiety on the surface of the clay.

Commercially available organoclays include, for example, Claytone AF from Southern Clay Products and the Bentone®, Baragel®, and Nykon® families of organoclays from RHEOX. Other suitable clays include those disclosed in U.S. Pat. No. 5,634,969 to Cody et al., the contents of which are hereby incorporated by reference. A preferred organoclay is Baragel® 10.

The clays are typically in the form of agglomerated platelet stacks. When sufficient mechanical and/or chemical energy is applied to the stacks, the stacks can be delaminated. The delamination occurs more rapidly as the temperature of the fluid containing the organoclay is released.

Some organoclays are referred to as self-activating, which means that polar activators are not required to achieve a full dispersion of the organoclay platelets. Other clays, which are not self-activating, optionally may include the presence of a polar activator, for example, a polar organic solvent, to achieve adequate delamination. Polar activators function by getting between two platelets of clay and causing them to swell apart. This reduces the attractive forces between them so that shear forces can tear them apart.

Suitable polar activators include acetone, methanol, ethanol, propylene carbonate, and aqueous solutions of the above. The activator does not necessarily have to be soluble in the carrier fluid. However, the amount of polar additive must be carefully selected. Too much additive can reduce the resulting gel strength. Too little additive, and the platelets will remain tightly bound in their stacks, and be unable to delaminate. Typically, the amount of polar activator is between about 10 to 80, preferably 30 to 60, percent by weight of the clay. However, the ideal ratio of clay to polar activator varies for each clay and each polar activator, and also for each clay/carrier fluid combination.

Those of skill in the art can readily determine an appropriate amount of polar activator. For example, the activator can be added and the mixture stirred for about one minute while the viscosity is monitored. If there is insufficient activator, maximum viscosity will not be reached, because the clay will is activated and fully dispersed. Activator can be added until maximum viscosity is reached, at which time, the clay will be activated and fully dispersed.

When the composition is prepared, it may be necessary to subject the organoclays to high shear stress to delaminate the organoclay platelets. There are several means for providing the high shear stress. Examples include colloid mills and homogenizers.

Preferably, the combination of the organoclay and carrier fluid, with or without a polar activator, forms a gel that has higher viscosity and yield stress than the carrier fluid alone.

D. Optional Components

Optional components include carboxylate soaps, dispersants, corrosion inhibitors, lubricants, extreme pressure anti-wear additives, antioxidants, thixotropic agents and conventional suspension agents. Carboxylate soaps include ferrous oleate, ferrous naphthenate, ferrous stearate, aluminum di- and tri-stearate, lithium stearate, calcium stearate, zinc stearate and sodium stearate, and surfactants such as sulfonates, phosphate esters, stearic acid, glycerol monooleate, sorbitan sesquioleate, laurates, fatty acids, fatty alcohols, fluoroaliphatic polymeric esters, and titanate, aluminate and zirconate coupling agents and other surface active agents. Polyalkylene diols (i.e., polyethylene glycol) and partially esterified polyols can also be included. Suitable thixotropic additives are disclosed, for example, in U.S. Pat. No. 5,645,752, the contents of which are hereby incorporated by reference. Thixotropic additives include hydrogen-bonding thixotropic agents, polymer-modified metal oxides, or mixtures thereof.

II. Devices Including the Magnetorheological Fluid Composition

The magnetorheological fluid compositions described herein can be used in a number of devices, including brakes, pistons, clutches, dampers, exercise equipment, controllable composite structures and structural elements. Examples of dampers which include magnetorheological fluids are disclosed in U.S. Pat. Nos. 5,390,121 and 5,277,281, the contents of which are hereby incorporated by reference. An apparatus for variably damping motion which employs a magnetorheological fluid can include the following elements:

a) a housing for containing a volume of magnetorheological fluid;
b) a piston adapted for movement within the fluid-containing housing, where the piston is made of a ferrous metal, incorporating therein a number N of windings of an electrically conductive wire defining a coil which produces magnetic flux in and around the piston, and
c) valve means associated with the housing an/or the piston for controlling movement of the magnetorheological fluid.

U.S. Pat. No. 5,816,587, the contents of which are hereby incorporated by reference, discloses a variable stiffness suspension bushing that can be used in a suspension of a motor vehicle to reduce brake shudder. The bushing includes a shaft or rod connected to a suspension member, an inner cylinder fixedly connected to the shaft or rod, and an outer cylinder fixedly connected to a chassis member. The magnetorheological fluids disclosed herein can be interposed between the inner and outer cylinders, and a coil disposed about the inner cylinder. When the coil is energized by electrical current, provided, for example, from a suspension control module, a variable magnetic field is generated so as to influence the magnetorheological fluid. The variable stiffness values of the fluid provide the bushing with variable stiffness characteristics.

The flow of the magnetorheological fluids described herein can be controlled using a valve, as disclosed, for example, in U.S. Pat. No. 5,353,839, the contents of which are hereby incorporated by reference. The mechanical properties of the magnetorheological fluid within the valve can be varied by applying a magnetic field. The valve can include a magnetoconducting body with a magnetic core that houses an induction coil winding, and a hydraulic channel located between the outside of the core and the inside of the body connected to a fluid inlet port and an outlet port, in which magnetorheological fluid flows from the inlet port through the hydraulic line to the outlet port. Devices employing magnetorheological valves are also described in the '839 patent.

Controllable composite structures or structural elements, such as those described in U.S. Pat. No. 5,547,049 to Weiss et al., the contents of which are hereby incorporated by reference, can be prepared. These composite structures or structural elements enclose magnetorheological fluids as a structural component between opposing containment layers to form at least a portion of any variety of extended mechanical systems, such as plates, panels, beams and bars or structures including these elements. The control of the stiffness and damping properties of the structure or structural elements can be accomplished by changing the shear and compression/tension moduli of the magnetorheological fluid by varying the applied magnetic field. The composite structures of the present invention may be incorporated into a wide variety of mechanical systems for control of vibration and other properties. The flexible structural element can be in the form of a beam, panel, bar, or plate.

III. Methods for Making the Magnetorheological Fluid Composition

The fluids of the invention can be made by any of a variety of conventional mixing methods. If the clay is not self-activating, an activator can be added to help disperse the clay. Preferred activators include propylene carbonate, methanol, acetone and water. The maximum product viscosity indicates full dispersion and activation of the clay. Enhancement of the settling stability can be evaluated using a settling test. In one embodiment, the clay is mixed with the carrier fluid and a polar activator to form a pre-gel before the magnetic-responsive particles are added.

IV. Methods for Evaluating the Magnetorheological Fluid Compositions

The hardness of any settlement on the bottom of the composition can be measured using a universal testing machine (which pushes or pulls a probe and measures the load), for example, an Instron, in which a probe attached to a transducer is pushed into the sediment cake and the resistance measured. In addition, a re-dispersion test can be performed, where the mixture is re-agitated and the ability of the composition to form a uniform dispersion is measured by visual inspection or the hardness test.

The present invention will be better understood with reference to the following non-limiting examples.

EXAMPLES

Magnetorheological fluids were prepared by mixing together the following components in the weight percents shown in Table I: carbonyl iron particles (R2430 available from ISP); polyalphaolefin ("PAO") oil carrier fluid (DURASYN 162 and 164 available from Albermarle Corporation); an organomolybdenum compound (MOLYVAN 855 available from the Vanderbilt Corp); a phosphate additive (VANLUBE 9123 available from Vanderbilt Corp.); a clay additive; and lithium stearate. The clay additives are as follows: GENIE GEL grease (a montmorillonite clay), GENIE GEL 22 (a hydrophilic montmorillonite clay) and GENIE GEL GLS (a montmorillonite clay) all available from TOW Industries; CLAYTONE APA (a montmorillonite clay) and CLAYTONE EM (a montmorillonite clay) available from Southern Clay Products Inc.; ATTAGEL 50 (a mineral) available from Englehard; BARAGEL 10 (a bentonite clay) available from RHEOX, Inc.; and RHEOLUBE 737 (a grease that includes poly-α-olefin oils and organoclays).

The settling behavior of the fluids was measured in a two week long test. Approximately 400 ml of the fluid was poured into a can, which was then thermally cycled by placing the can in an oven at 70° C. for 64 hours. The can was then placed in a −20° C. freezer for 2 hours, the oven at 70° C. for 4 hours, the freezer for 2 hours at −20° C., and finally the oven at 70° C. for 16 hours. The 2/4/2/16 hour set of cycles was repeated four more times. The can was then aged for 64 hours at 70° C. and the 2/4/2/16 hour cycle repeated four more times. The final cycle was a 2/4/2 hour cycle −20/70/−20° C. The settling hardness after thermal cycling was measured by a mechanical tension/compression test machine using a 10 N load cell. A probe 140 mm long, 12.5 mm in diameter was attached to the load cell. The probe was machined to a conical shape at one end with the cone 12.5 mm in height. The end of the tip was flattened at a 25° angle to a diameter of 1.2 mm. The test was carried out by lowering the probe into the fluid at a rate of 50 mm/min to a pre-determined depth. The hardness value reported was the average of 5 values measured at different places radially symmetric about 20 mm from the wall of the can. The higher the hardness value the more difficult it is to re-disperse the fluid.

TABLE I

Formulations of MR fluids

| Example | R2430 | Durasyn 162 | Durasyn 164 | Molyvan 855 | Additive | Clay | Stearate |
|---|---|---|---|---|---|---|---|
| 1 | 78.93 | | 18.79 | 0.7885 | 0.5616 acetone | 0.9339 Genie Gel Grease | |
| 2 | 79.7 | | 18.34 | 0.7962 | 0.2674 acetone | 0.8908 Claytone APA | |
| 3 | 76.92 | | 18.39 | 0.7983 | | 0.8932 Claytone APA | |
| 4 (Comparative) | 79.58 | | 18.32 | 0.795 | | 1.308 Genie Gel 22 | |
| 5 | 79.87 | | 18.38 | 0.7979 | | 0.9541 Genie Gel GLS | |
| 6 (Comparative) | 79.64 | | 18.33 | 0.7956 | | 1.2354 Attagel 50 | |
| 7 | 79.92 | | 18.39 | 0.7983 | | 0.8932 Claytone EM | |
| 8 | 79.90 | | 18.39 | 0.7982 | | 0.9137 Baragel 10 | |
| 9 (Comparative) | 79.99 | | 18.41 | 0.7990 | | 0.8043 Baragel 3000 | |
| 10 (Comparative) | 81.89 | 11.20 | 0 | 0.4095 | 0.8189 Vanlube 9123 | None | 5.6801 |
| 11 (Comparative) | 81.92 | 10.29 | | 0.4096 | 0.8193 Vanlube 9123 | 2.9811 Rheolube 737 | 3.5883 |
| 12 | 82.41 | 10.01 | | 0.4121 | 0.8242 Vanlube 9123 | 4.4729 Rheolube 737 | 1.8744 |
| 13 | 81.62 | 9.60 | | 0.4081 | 0.8163 Vanlube 9123 | 6.3652 Rheolube 737 | 1.1916 |
| 14 | 81.55 | 9.18 | | 0.4078 | 0.8156 Vanlube 9123 | 8.05 Rheolube 737 | 0 |

The physical properties of the above formulations were measured and are listed below in Table II.

TABLE II

| Example # | 2 wk test Sediment Hardness (N) |
|---|---|
| 1 | 0.7 |
| 2 | 1.0 |
| 3 | 0.9 |
| 4 (Comparative) | Settled Hard (greater than 10) |
| 5 | 2.6 |
| 6 (Comparative) | 6.2 |
| 7 | 1.5 |
| 8 | 0.5 |
| 9 (Comparative) | 3.3 |
| 10 (Comparative) | 3.2 |
| 11 (Comparative) | 3.2 |
| 12 | 2.5 |
| 13 | 0.9 |
| 14 | 1.2 |

A sediment hardness of greater than 3.0 is indicative of unacceptable difficulty in re-dispersion. It is apparent from the results in Table II that (1) not all clays provide acceptable re-dispersibility (see Comparative Examples 4, 6, 9 and 11 and (2) inclusion of certain clay additives improves the re-dispersibility relative to fluids that do not contain the clay (see Comparative Example 10).

We claim:

1. A magnetorheological material comprising a carrier fluid; magnetic-responsive particles having average diameters of 0.10 to 1000 $\mu$m; and a hydrophobic organoclay derived from a bentonite, wherein the magnetorheological material has sediment layer hardness value of less than 3.0 N.

2. The material of claim 1 wherein the carrier fluid comprises a synthetic hydrocarbon oil.

3. The material of claim 1 wherein the magnetizable particle is selected from at least one of the group of iron, iron alloys, iron oxides, iron nitride, iron carbide, carbonyl iron, nickel, cobalt, chromium dioxide, stainless steel and silicon steel.

4. The material of claim 1 wherein the clay is derived from a montmorillonite clay.

5. The material of claim 1 further comprising a polar activator to assist in dispersing the organoclay.

6. The material of claim 1 wherein the organoclay is present in an amount of 0.1 to 6.5 weight percent, based on the weight of the total composition.

7. The material of claim 1 wherein the carrier fluid is a non-polar organic liquid.

8. The material of claim 1 wherein the organoclay is present in an amount of 0.1 to 6.5 weight percent, based on the weight of the liquid portion of the composition and the carrier fluid comprises a synthetic hydrocarbon oil.

9. The material of claim 1 wherein the magnetic-responsive particles have an average particle diameter of greater than 1.0 $\mu$m.

* * * * *